US006058581A

United States Patent [19]

Ehrlund

[11] Patent Number: 6,058,581

[45] Date of Patent: May 9, 2000

[54] JEWELRY CLASP, PARTICULARLY FOR EARRINGS

[76] Inventor: Åke Ehrlund, Äkvjvarnsvägen 177, Spånga 16354, Sweden

[21] Appl. No.: 09/091,541

[22] PCT Filed: Dec. 21, 1995

[86] PCT No.: PCT/SE95/01561

§ 371 Date: Jun. 17, 1998

§ 102(e) Date: Jun. 17, 1998

[87] PCT Pub. No.: WO97/23145

PCT Pub. Date: Jul. 3, 1997

[51] Int. Cl.[7] ..... A44B 9/00; F16B 2/00; A44C 7/00

[52] U.S. Cl. ..... 24/705; 24/580; 24/701; 24/667; 63/12

[58] Field of Search ..... 24/705, 701, 702, 24/707.5, 666, 667, 580, 499; 53/12

[56] References Cited

U.S. PATENT DOCUMENTS

| | | | |
|---|---|---|---|
| 402,071 | 4/1889 | Doran | 24/705 |
| 2,627,637 | 2/1953 | Downing | 24/701 |
| 3,040,406 | 6/1962 | Artzt | 63/12 |
| 3,808,647 | 5/1974 | Febrer | 24/667 |
| 5,044,176 | 9/1991 | King | 63/12 |
| 5,628,096 | 5/1997 | Watters et al. | 24/580 |

FOREIGN PATENT DOCUMENTS

| | | | |
|---|---|---|---|
| 3009607 | 9/1981 | Germany | 63/12 |
| 1230411 | 5/1971 | United Kingdom | 24/705 |

*Primary Examiner*—Victor N. Sakran
*Attorney, Agent, or Firm*—Cowan, Liebowitz & Latman, P.C.; William H. Dippert

[57] ABSTRACT

An elongated semi-product from which a clasp can be formed includes at each end at least one through-penetrating hole wherein when bent to form said clasp the semi-product forms a generally closed cavity with the mutually opposite ends of said product forming overlapping legs and the openings at the ends of said semi-product being intended to coincide in one position of the legs to enable said stem-part to be inserted easily through the two holes in said legs, wherein in another position of said legs the holes provided in the edge regions of the ends of said legs will be pressed against a portion of reduced diameter on the stem so as to hold an ornament in place. According to the invention, at least one of the two opposing openings in the semi-product has an elongated and irregular shape so as to include at least two holes of different sizes, and at least one opening extends transversely to the longitudinal axis of the semi-product.

7 Claims, 2 Drawing Sheets

JEWELRY CLASP, PARTICULARLY FOR EARRINGS

The present invention relates to an elongated, plate-like semi-product which has a certain degree of springless and from which there is produced a jewelry clasp for securing a piece of jewelry comprising an ornamental object and a stem, such as an earring, an eardrop or a broach for instance, wherein the stem or tang is intended to coact lockingly with the clasp. The elongated semi-product includes at least one through-penetrating opening at each end thereof, or in the proximity of each end thereof, and is intended to be bent in a manner to define mutually overlapping legs such that the holes at the ends of said legs will be in register with one another in one position of said legs and therewith enable the stem to be inserted easily through said openings, and such that the surfaces defining said holes will be pressed against a stem portion of smaller cross-section in another position of the legs and therewith lock the clasp to the stem.

BACKGROUND OF THE INVENTION

Ear-carried ornaments or jewelry, for instance earrings, or eardrops, can be secured in several different ways. For instance, the jewelry can be secured to the wearer's earlobe with the aid of a clip which clamps the jewelry to the earlobe. When the jewelry or ornament concerned includes a stem or tang of round cross-section, the earlobes will be pierced and the stem inserted through the hole and appropriately secured. The clasp, or like locking device, is then located behind the earlobe, with the ornament or jewel seated against or hanging from the front part of the earlobe.

DESCRIPTION OF THE PRIOR ART

Figure 1:
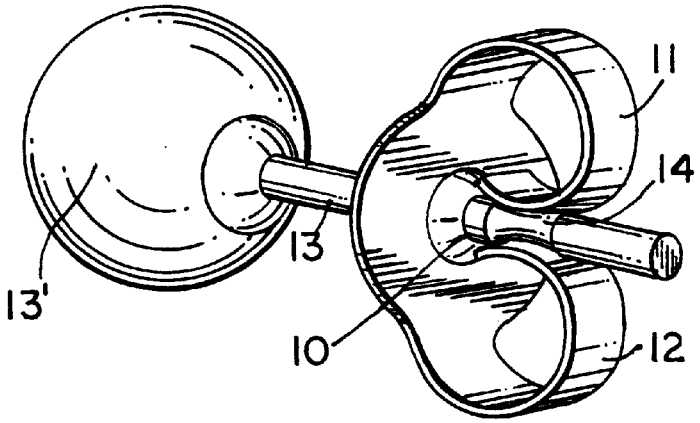
FIG. 1 PRIOR ART

With regard to this latter category of ear-carried ornaments, part of the stem of the ornament is screw-threaded for coaction with a locking nut which, when fitted, lies against the rear side of the earlobe and prevents the stem from sliding unintentionally from the pierced hole in the earlobe. Another and more frequently used clasp design is illustrated in FIG. 1 of the accompanying drawings. An initially elongated, plate-like piece of material includes a center hole 10 and its two mutually opposite ends have been bent to form mutually opposite curved legs 11, 12. After having formed the legs of the clasp, the hole 10 will be located centrally therebetween. The ornament, or jewel, is referenced 13' in the Figure and includes a stem 13 which is inserted through a hole pierced in the earlobe of the wearer. The stem 13 includes a part of smaller cross-section, i.e. a reduced part 14 against which the extremities of the legs 11, 12 are pressed into frictional engagement. It will be understood that the legs 11, 12 have a given springiness. This known clasp design, has obvious drawbacks. As the material from which the clasp is made becomes fatigued, the frictional engagement between the stem and the rounded abutment surfaces of the clasp will decrease. This fatigue of the material caused by repeated use of the clasp cannot be controlled by the user, and when the strength of said frictional engagement is reduced, the stem is liable to slide out of the clasp. Another drawback with the clasp illustrated in FIG. 1 resides in the compromise that is made with regard to the fact that the locking friction between the legs must not be excessively large, while enabling the ornament to be fastened in and released from the ear by gripping the ornamental part of the earring with the fingers of one hand and moving the stem into and out of the pierced hole while manipulating the clasp with the other hand. The clasp is also small and is thus able to slip from the hand of the wearer when releasing the clasp, with the risk of being lost.

Figure 4:
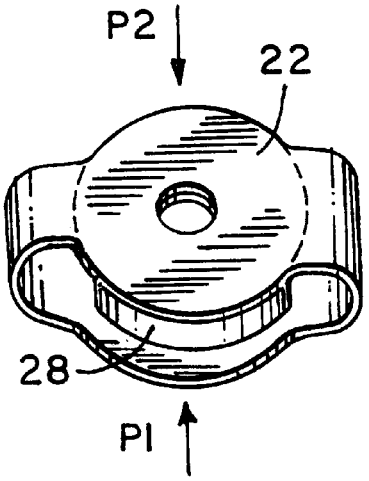

A similar clasp is disclosed in DE-C-30 09 607. FIGS. 4, 5 of this earlier publication illustrate an elongated, plate-like semi-product having a circular opening at or in the proximity of each end-part thereof. The semi-product is bent to form two legs which overlap one another in the longitudinal direction of the semi-product, wherein the holes and the ends of the legs can be brought into alignment with one another by exerting a force in the longitudinal direction of the semi-product, so as to enable the stem of an ear-carried ornament to be inserted into a hole pierced in the earlobe of the wearer. As this force is released, the legs spring away from one another (or at least one leg springs away from the other) so as to mechanically lock the stem. As with the aforementioned known clasp design, this latter clasp has the drawback of being brought to an operative state by the application of pressure in the "spring" direction of the locking element, i.e. in the longitudinal direction of the semi-product, and that locking is effected solely against one side of the reduced stem-portion and against its conical junction with the remainder of the stem. Thus, it is the springiness of the material that determines the long-term functioning of the clasp, in combination with the size of the contact surface area between the reduced part of the stem and the hole-defining surfaces. The more springy the material, the better the mechanical locking of the stem, because the defining edge of the mutually opposite holes or openings will act with an oppositely acting spring force against the reduced part of said stem. These contact surfaces are very small in area, however, and gradual impairment of the springless of said material will increase the risk of impairment of the mechanical locking effect earlier achieved, or in part. In practice, only one of the two legs is springy in the aforesaid concept. It will also be remembered that a clasp a locking device of this kind has very small dimensions. For instance, the semi-product from which the clasp is formed may have a length of only some 13 mm. When an ornament is attached to the ear of the wearer, the clasp is, in principle, secured by touch and feel alone. The following features are required of a clasp for ear-carried ornaments:

a) It must be possible to guide the stem of the ornament easily into coaction with the clasp.

b) Despite the small dimensions of the clasp, the user must be able to grip the clasp firmly and reduce or eliminate the risk of the clasp "flipping" from the user's grip and being lost.

c) The spring force inherent in the clasp must be highly durable. This is achieved when the spring force is only required to return the leg or legs of the clasp to its/their rest position (locking position) and not to lock the clasp to the stem.

d) The contact surface between the reduced part of the stem and the hole-defining surfaces is optimal in ensuring positive and reliable mechanical locking of the clasp.

Taking as its starting point the points discussed above and the jewelry-clasp semi-product known particularly from DE-C-30 09 607, which is considered to represent the most relevant prior art, the present invention provides a semi-product of the aforedescribed kind which is characterized by the features set forth in the characterizing clause of the following claim 1. The invention also relates to a clasp or locking device formed from such a semi-product.

Figure 3:
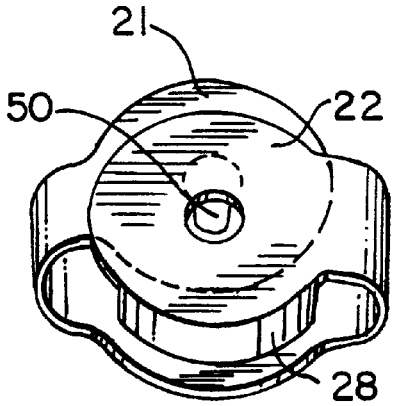
Figure 2A:
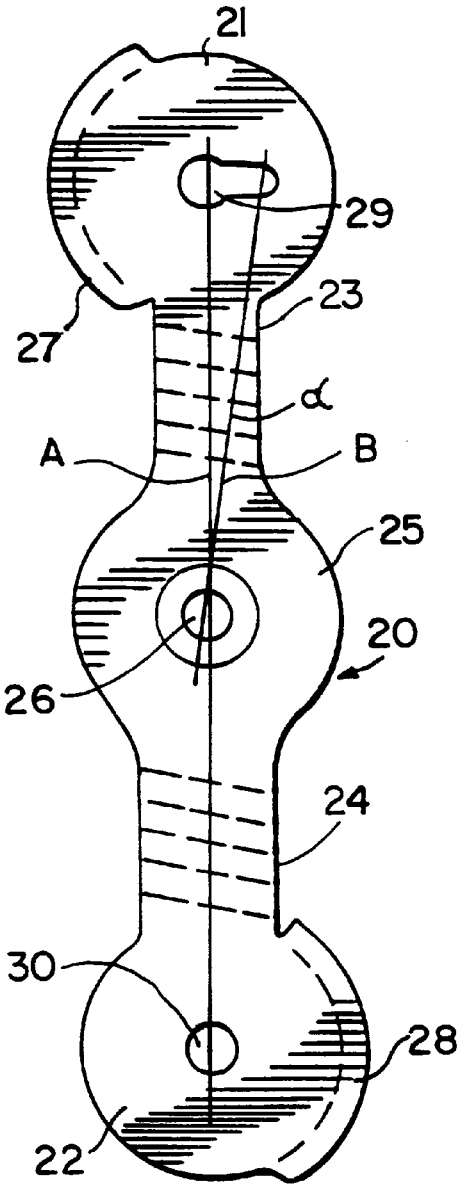
Figure 2B:
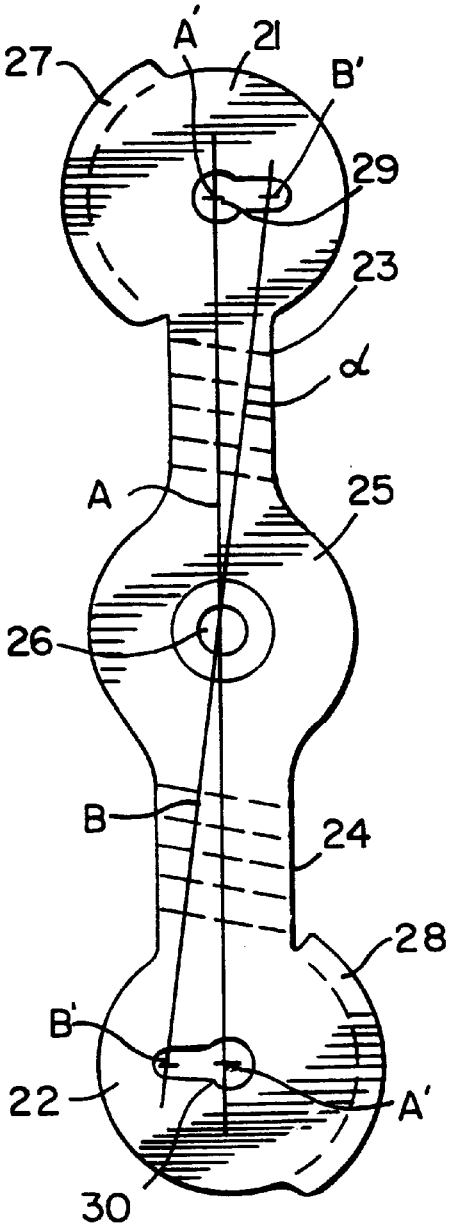

So that the invention will be more readily understood and further features thereof made apparent, the invention will now be described with reference to an exemplifying embodiment thereof and also with reference to the accompanying drawings, in which FIG. 1 is a perspective view of a known clasp and illustrates its coaction with a circular stem or tang whose one end is connected to an ornamental object, for instance a pearl;

FIG. 2*a* illustrates a first preferred embodiment of an inventive clasp semi-product;

FIG. 2*b* illustrates a modified form of the semi-product shown in FIG. 2*a*;

FIG. 3 shown the semi-product of FIG. 2*a* bent into the form of a clasp, said clasp being shown in a first position, a rest position; and FIG. 4 shows the clasp arrangement of FIG. 3 with the legs of said clasp being brought by means of oppositely directed forces to a position in which the openings in the legs are principly in register with one another and with a centrally located reduced portion of the stem.

The known technique illustrated in FIG. 1 has already been described above.

Illustrated in FIG. 2*a* is a referred embodiment of an elongated and plate-like semi-product 20 from which the improved, inventive jewelry clasp can be produced. The semi-product 20 is preferably comprised of a precious metal, for instance gold, although other, particularly metallic, materials can be used. The semi-product 20 has two mutually opposing, widened end-parts 21 and 22, each of which merges with a respective web part 23 and 24, which in turn merge with a widened center-part 25 which includes guide means in the form of a through-penetrating opening or a blind hole 26 having a conical lead-in and functioning a s a stem guide. When seen in the plane of the drawing, each of the widened end-parts of the semi-product has a respective angled lip 27 and 28 which extends around a part of the perimeter, or periphery, of its respective widened part 21, 22 and define an angle of about 90° therewith. As will be seen from the drawings, the upper lip 27 is placed on the left side of its widened part 21, whereas the lower lip 28 is placed on the right side of the widened part 22. Each widened end-part 21 and 22 has a respective through-penetrating opening 29 and 30. In the FIG. 2*a* embodiment, which is the preferred embodiment, one end-part 22 of the semi-product 20 has a central, circular opening 30, whereas the opening 29 in the opposite end-part 21 is an irregular, elongated opening which extends transversely to the longitudinal axis of the semi-product 20. By "elongated, irregular" is meant that the opening 29 has a form such as to include at least two holes of mutually different sizes, i.e. one relatively small hole and one larger hole. Examples of such irregular shapes are pear shapes, keyhole shapes or oval shapes. The openings 29, 30 of the preferred embodiment have a keyhole shape. FIG. 2*a* shows a geometric axis A which extends between the round hole 30 in the lower end of the semi-product shown in FIG. 2*a*, and the center of the upper, elongated opening 29, namely the hole of greater diameter, while passing through the center hole 26. Also shown is a geometric axis B which extends from the center hole 26 to the center of the hole of smaller diameter in the elongated opening 29.

FIG. 2*b* illustrates the case when the openings 29, 30 at respective ends of the semi-product are identical with one another, in the illustrated case a keyhole shape although the holes may equally as well have a pear shape or an oval shape. In the illustrated case, the elongated openings 29, 30 extend transversely to the longitudinal axis of the semi-product 20 and are mirror images of one another. In the illustrated case, the geometric axis A connects the centra A'—A' of the holes of larger diameter in respective elongated openings 29, 30. The broken line axis B connects the centra B'—B' of respective holes of smaller diameter in said elongated openings 29, 30. The axes A and B intersect one another at the center of the semi-product 20, i.e. in the center of the blind hole or the through-penetrating opening 26.

Referring back to FIG. 2*a*, the larger hole in the opening 29 in the widend end-part 21 and the round opening 20 in the widened end-part 22 are dimensioned to enable the stem or tang (not shown) of a piece of jewelry (also not shown) to be easily inserted, while the smaller hole in the opening 29 is dimensioned to tightly embrace at least the reduced portion of the stem and to provide optimal abutment surfaces therewith.

The clasp, or like locking device, is formed by bending the semi-product 20 shown in FIGS. 2*a* and 2*b* in a plane such that the widened end-parts will partially overlap one another. In other words, the semi-product 20 is bent in a plane which forms a right angle $\alpha$ with the axis B.

Bending of the semi-product 20 shown in FIG. 2*a* in this manner will result in a clasp of the configuration shown in FIG. 2. As will be seen, after bending the semi-product 20 in the aforedescribed manner, the legs 21 and 22 formed by the opposing end-parts of said product 20 will be displaced relative to one another in the transverse direction of the product 20, i.e. will partially overlap one another with the leg 22 having the transversely extending larger hole positioned beneath the leg 21 which has the single round hole 29. (The reverse position may also be applied.) The opening 50 defined in this position of the legs 21, 22 has a size which corresponds approximately to the diameter of the reduced part 14 of the stem (see FIG. 1). FIG. 3 thus illustrates the stem-securing state of the clasp, which is also the state in which the legs 21, 22 constantly strive to return to their original position as a result of the torsional forces acting thereon. The opening 50 is thus defined by both the round hole 30 of the one leg 22 and by the smaller hole in the elongated opening 29 of the other leg 21. FIG. 4 shown that the legs 21, 22 can be pressed together (the force arrows P1, P2), wherein the downwardly directed lips 27 and 28 function to guide the legs so that the holes 29, 30 in respective legs 21, 22 will coincide such that the round hole 30 in the leg 22 will be in register with the larger hole in the keyhole opening 29, which therewith defines an optimal opening that will enable the stem or tang of a piece of jewelry to be easily inserted into or removed from the clasp. The stiffness afforded by the lips 27, 28 makes relative lateral displacement of the legs impossible.

The inventive clasp affords the following advantages:

a) The locking effect afforded by the clasp is highly effective, due to the fact that the hole-defining surfaces are in contact with both sides of the reduced stem portion.

b) The "hole" that is formed by the openings 29, 30 when a stem or tang is to be inserted is maximally large, i.e. much larger than the diameter of the stem.

c) Because at least one of the openings 29, 30 extends transversely to the longitudinal axis of the semi-product, the legs 21, 22 are subjected to a force which acts transversely to the longitudinal axis of the semi-product, which is also its main "spring" direction.

d) The springiness of the semi-product 20 will not become dissipated, because this spring force is not used to lock the clasp.

The angled lips 27 and 28 function to guide the legs 21, 22 so that the openings 29, 30 will always be brought into appropriate alignment with one another in the aforesaid manner, and also function as abutments in a position in which optimal alignment of respective holes in the opening 29, 30 is achieved.

USE AND FUNCTION

When securing an ear-carried ornament with the aid of the novel clasp, the stem or tang of the ornament is first inserted through a hole pierced in an earlobe, for instance. That part of the stem which then projects out from behind the ear is inserted into the central hole 26 of the inventive clasp while, at the same time, exerting said force P1 and P2 on respective opposite legs so as to bring the openings 29 and 30 into mutual alignment and allow the stem to pass unhindered therethrough. The forces P1 and P2 are then relaxed, so that the reduced portion of the stem will be guided into the smaller hole of the elongated opening 29 and the clasp brought to the state shown in FIG. 3. The size of this latter opening is only insignificantly larger than the diameter of the reduced stem-portion, which means that the reduced stem-portion will abut three side-edges of the hole, therewith preventing the stem from moving axially in the hole and providing an effective mechanical locking effect. It will be seen that the guide lips of the inventive clasp arrangement contribute towards ensuring that the openings and holes 26, 29 and 30 will always be brought into mutual alignment when the aforesaid forces P1 and P2 are applied.

Although the invention has been described and illustrated with reference to a preferred embodiment thereof, it will be understood that the semi-product on which the novel clasp arrangement is based may be formed in a number of other ways. As before mentioned, the widened end-parts of the semi-product 20 may have a form other than round, for instance a polygonal form. At least one of the openings 29, 30 shall have a form which will provide holes of mutually different sizes.

Although the clasp has been described mainly with reference to ear-carried ornaments, such as earrings, eardrops and the like, it will be understood that the inventive clasp can also be used to fasten jewelry or ornaments to other facial features, such as the nose or lips for instance, when feasible.

It will also be understood that the invention is not restricted to the illustrated and described embodiments thereof and that modifications and changes can be made within the scope of the inventive concept as defined in the following claims.

I claim:

1. An elongated, plate-like semi-product (20) from which there can be formed a clasp or like locking device for holding in place a piece of jewelry comprising an ornamental part and a stem-part, where the stem portion is intended to coact with the clasp, wherein the semi-product (20) includes at each end or in the proximity of said ends at least one through-penetrating hole (29, 30), of which at least one (29) hole has an elongated and irregular shape so as to include at least two holes of different sizes, wherein when bent to form said clasp the semi-product (20) forms a generally closed cavity with the mutually opposite ends of said product (20) forming overlapping legs (21, 22) and the openings (29, 30) at the ends of said overlapping legs being intended to coincide in one position of the legs so as to enable said stem-part to be inserted easily through the two holes in said legs, wherein in another position of said legs the holes provided in the edge regions of the ends of said legs will be pressed against a portion of reduced diameter on the stem so as to hold the stem, and therewith the ornament, in place, characterized in that said at least one opening (29) extends transversely to the longitudinal axis of the semi-product (20) and, when the semi-product is bent in a known manner to form two mutually overlapping legs (21, 22), the step-part (24) can be inserted through both openings (29, 30) upon application of counter-directional forces on the legs (21, 22) transversely to their longitudinal direction, wherein release of said forces will cause the openings to be displaced relative to one another and away from each other to define a position in which the reduced stem-part coacts with the edges of the mutually opposing openings (29, 30) in said legs, wherein the mutually opposing ends of the product have a round shape, and merge with a relatively narrow web portion; and that each end of the semi-product includes a generally right-angled lip or collar (27, 28) which extends around at least a part of the periphery of its respective end.

2. A semi-product for producing a jewelry clasp in accordance with claim 1, characterized in that the leg (21) of the semi-product (20) that has said elongated and irregular opening which includes at least two holes of mutually different size is the bottom leg of the at least partially overlapping legs (21, 22).

3. A semi-product for producing a jewelry clasp in accordance with claim 2, characterized in that the other leg (22) of said mutually opposing legs (21, 22) has an opening (30) of circular or essentially circular shape.

4. A semi-product for producing a jewelry clasp in accordance with claim 1, characterized in that the openings in the two mutually opposing legs (21, 22) are identical or generally identical and have an elongated, irregular shape so as to both include two holes of mutually different sizes, wherein after bending the semi-product to define at least partially overlapping legs, the holes or openings (29, 30) will be mirror images of each other in the longitudinal direction of the semi-product.

5. A semi-product for producing a jewelry clasp in accordance with claims 1–4, characterized in that the elongated irregular opening or openings has/have a pear or keyhole configuration.

6. A method of bending an elongated semi-product to form a jewelry clasp and with the intention of forming at least partially overlapping lets, characterized by bending a semi-product of claim 1 in a plane in which an imaginary line extends between the central hole (21) of said semi-product (20) and the hole of smaller diameter in the elongated opening at the end of one leg forms a right angle with a bending plane.

7. A jewelry clasp produced in accordance with the method of claim 6.

* * * * *